United States Patent [19]

Williams

[11] Patent Number: 4,865,063

[45] Date of Patent: Sep. 12, 1989

[54] WIND RESISTIVE UMBRELLA

[76] Inventor: Curtis J. Williams, 12208 Harris Ave., Lynwood, Calif. 90262

[21] Appl. No.: 241,334

[22] Filed: Sep. 6, 1988

[51] Int. Cl.[4] ..... A45B 25/20

[52] U.S. Cl. ..... 135/35

[58] Field of Search ..... 135/35 V, 35 S, 35 R

[56] References Cited

U.S. PATENT DOCUMENTS

| | | | |
|---|---|---|---|
| 3,032,047 | 5/1962 | Wendorf | 135/35 V |
| 3,456,661 | 7/1969 | Farley | 135/35 V |
| 4,300,582 | 11/1981 | Desarno | 135/35 V |

FOREIGN PATENT DOCUMENTS

| | | | |
|---|---|---|---|
| 106457 | 1/1927 | Austria | 135/35 V |

*Primary Examiner*—Henry E. Raduazo

*Attorney, Agent, or Firm*—Albert O. Cota

[57] ABSTRACT

An umbrella which has a handle (20), for gripping, attached to a staff (22) and a number of ribs (26) pivotally connected to the staff, each having a strut (28) rotatably joined therebetween. A canopy (32) having an opening (34) in the center covers the ribs, also a cover (36), larger in diameter than the opening, overlays the canopy creating a water shedding shield. A movable ring (38) attaches the cover to the staff allowing vertical movement of the cover. The cover is reinforced with straps (40) and the inside of the canopy is also reinforced with at least a pair of radial straps (46). The umbrella relieves the air inside when the pressure differential between the inside and outside is increased due to the wind billowing the cover upwardly on the ring, exposing a series of vents between the ribs at the interface of the cover to the canopy expelling the air readily thereby protecting the umbrella from turning inside out.

10 Claims, 2 Drawing Sheets

WIND RESISTIVE UMBRELLA

TECHNICAL FIELD

The present invention relates to collapsible umbrellas in general, and more specifically to an umbrella that is provided with an air relieving opening and cover with canopy reinforcing.

BACKGROUND ART

Previously, many types of umbrellas have been in use endeavoring to provide an effective means to prevent turning inside out during conditions of high wind known to accompany a rainstorm. In most cases some type of vent has been incorporated into the center of the umbrella, either a single, or multiple holes protected by some type of fabric cover. Further, structure has been added to reinforce the ribs, however, this approach has not been entirely successful, nor have the openings by themselves provided the optimum solution.

A search of the prior art did not disclose any patents that read directly on the claims of the instant invention, however, the following U.S. patents were considered related:

| Patent No. | Inventor | Issue Date |
|---|---|---|
| DES. 162,617 | Benivegna | Mar. 27, 1951 |
| 1,031,974 | Thomas | Jul. 9, 1912 |
| 3,032,047 | Wendorf | May 1, 1962 |
| 3,456,661 | Farley | Jul. 22, 1969 |
| 3,960,162 | Noel | Jun. 1, 1976 |

Benivegna illustrates a windproof umbrella with the canopy made in three pieces with the first two overlapping the third. This is a design patent, therefore, no structure is disclosed.

Thomas teaches an umbrella having a plurality of holes in the top thereof, covered by a device with a thimble portion fitting the upper end of the rod with fabric extending beyond a plurality of openings in the canopy. The device in each embodiment is permanently raised above the canopy.

Wendorf discloses a storm umbrella, again having a plurality of holes and a cover similar to that above in combination with a number of guy members attached between the post and the tips of the ribs. The guy members have various embodiments, however, all are flexible, but do not stretch or yield in length to accommodate wind velocity and magnitude.

Farley employs a plurality of arcuate flying vents comprised of tapered, generally triangular gores extending and tapered with increasing width beyond the perimeter of an opening in the umbrella canopy. The flying vents fill with air rising from beneath and expel the air outwardly providing aerodynamic stability.

Noel incorporates a plurality of vents comprised of pivotal flaps fabricated of semi-rigid material resiliently seamed to the ribs that open and expel the air due to the flexing of the ribs under wind conditions. The vents are positioned near the swinging connections of the ribs and struts allowing pressure to be relieved at the critical point.

DISCLOSURE OF THE INVENTION

The problem of umbrellas turning inside out during periods of high winds often accompanying rainstorms is as old as umbrellas themselves. The reason is that umbrellas historically rely upon a lightweight structure of ribs and struts with a canopy stretched tightly thereupon in a convex shape. The fact that weight is important and size is dictated by utility, the strength is basically insufficient to endure pressure differentials when subjected to high wind gusts. Prior art has attempted to relieve the pressure with some type of vent, however, conventional umbrellas still lack the strength to endure such forces. It is, therefore, a primary object of the invention to combine a vent with structural reinforcement, both inside and outside of the canopy, that not only provide the structural integrity, but also yield slightly giving the needed strength without the rigidity that would cause undue forces upon the lightweight framework.

An important object of the invention deals with the manner in which the air is relieved. Unlike prior art, the invention provides a simple circular cover that overlaps a hole in the center of the canopy. As the cover is also circular in shape, it lays flat upon the canopy and appears to be a second skin with no wrinkles or bulges present as in most prior art. The uniqueness is portrayed in the attachment of the center portion not to a central staff, as taught by others, but, instead to a slideable ring that moves upwardly as much as 0.50 inches (1.27 cm) from its normal position. This arrangement allows the cover to bellow outwardly creating a void over the hole in the canopy expelling the air, relieving the pressure inside without the unwanted bulk and unsightly wrinkles under normal usage.

Another object of the invention is that the canopy reinforcing is both on the outside in an axial direction connecting from the ring to each of the ribs over the top of the cover, and on the inside in a radial manner attaching the ribs together in one or more circumferential positions, one of which is at the intersection of the ribs and struts. This reinforcing is normally made of elastic bands that stretch within limits and yet yield at first with increasing resistance provided. Not only does this reinforcement accomplish the purpose, but the asthetics of the umbrella are not affected, as the elastic material may be the same color and blend into the fabric design and stitching as to not be obvious.

Still another object of the invention eliminates the need for separate or special straps to enclose the air escape cover when the umbrella is retracted, since the ring seeks its own level making the cover fold flat against the canopy as if it were only one piece.

Yet another object of the invention allows the umbrella to be fabricated with only slight modifications from the conventional form. The fact that the cover is flat and may be cut from one piece simplifies the construction and the reinforcing may be added during the sewing process of the canopy allowing a cost effective product with greater strength and utility.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
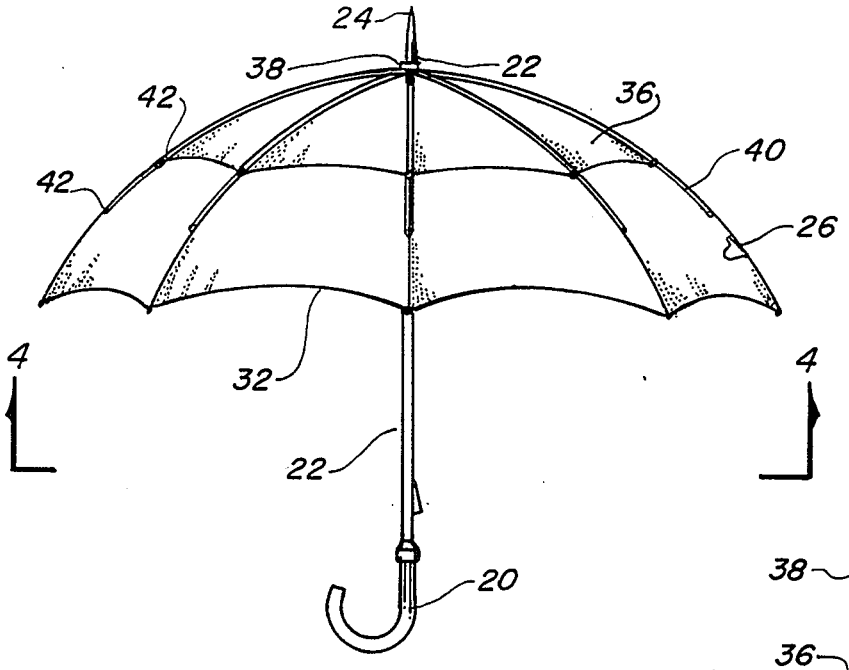
FIG. 1 is a side elevational view of the preferred embodiment.
Figure 2:
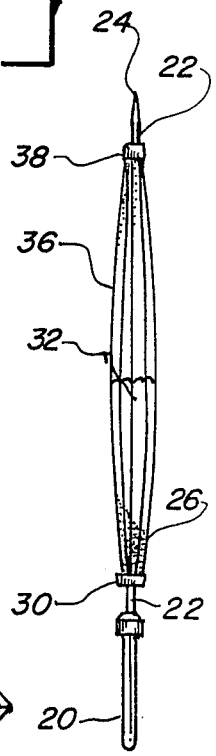
FIG. 2 is a side view of the umbrella in its closed position.

The best mode for carrying out the invention is presented in terms of a preferred embodiment. The preferred embodiment, as shown in FIGS. 1 through 5, is comprised of handle means 20 for gripping and carrying the device. Any handle shape may be utilized as this element is well known in the art. The handle 20 is attached to a central staff 22 which may be any shape, solid or hollow, with round being preferred. The limitations are that the staff 22 must have sufficient structural integrity to maintain stability to serve the purpose of the main structure in the form of a pole, post, or upright rod. The staff 22 further is extended to an apex 24 on the end opposite the handle 20, preferably tapered in shape, but blunted at the tip.

A plurality of ribs 26 are connected together by pivotal means near the apex 24 of the staff 22 and extend radially on the other end, preferably in a symmetrical manner. The ribs 26 are rotatably connected to a plurality of struts 28 in an area somewhere in between the staff apex 24 and the rib connection. The other end of the strut 28 is connected to sliding means in the form of a collar 30, or the like. Since both ends of the strut 28 are pivotal, the ribs 26 are extended away from the staff, as urged by the struts, when the collar 30 is slid upwardly on the staff 22. The extended ribs are locked into place when the struts 28 reach an over center angular relationship.

A canopy 32 covers the framework of radially extending ribs 26 and is secured to the end of each individual rib. The canopy 32 is round in shape and is held in tension by the ribs 26 when they are in the open position forming an inverted disk like structure. In the center of the canopy 32 is an air relieving opening 34 radially adjacent to the central staff 22 spaced evenly therefrom. This opening 34 allows air to be relieved from the inside of the umbrella when the wind creates a pressure differential between the inside and outside surface of the canopy 32. The size of the opening 34 may vary, however, a ratio of from 0.2 to 0.3 to the overall diameter of the umbrella is preferred.

Figure 3:
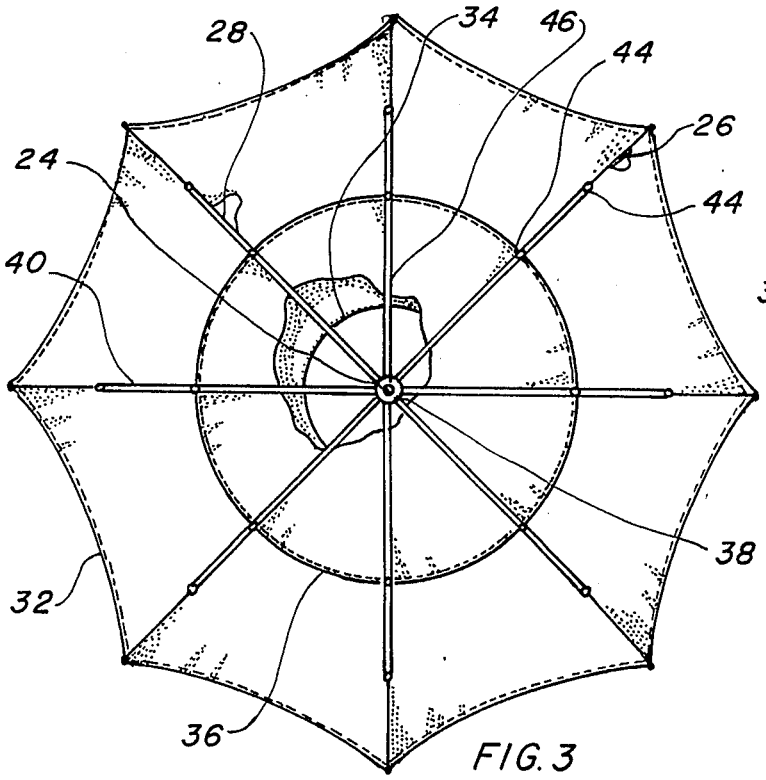
FIG. 3 is a plan view of the preferred embodiment, with a portion cut-away illustrating the hole in the canopy.
Figure 4:
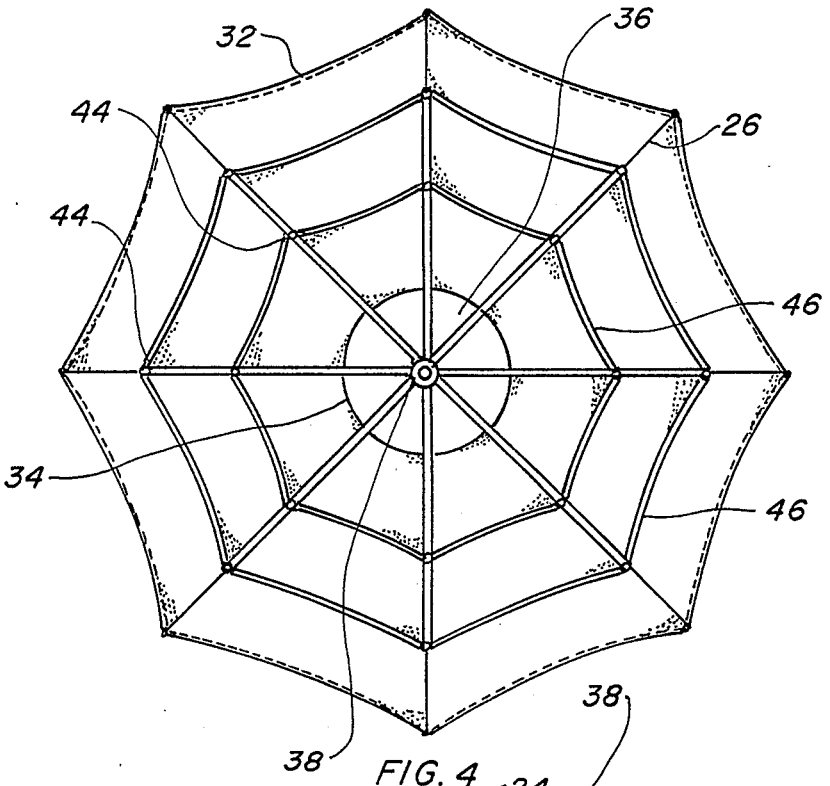
FIG. 4 is a cross-sectional view taken along lines 4—4 of FIG. 1.
Figure 5:
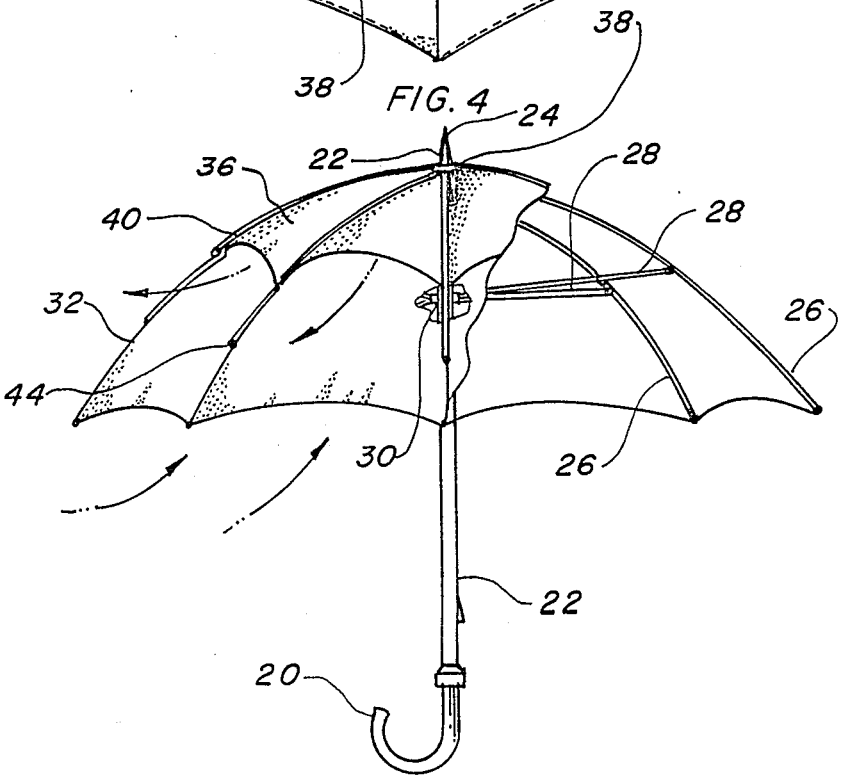
FIG. 5 is a side elevational view with the canopy and cover partially cut-away for clarity and air direction shown by phantom lines billowing the cover and venting from between the cover and the canopy.

An air escape cover 36 overlays the opening 34 and overlaps the canopy 32, as the outside diameter of the cover is greater by more than 100 percent than the inside diameter of the air relieving opening 34, allowing the air to escape from the inside of the umbrella while still maintaining the watershedding capability of the device. A hollow movable ring 38 slideably encompasses the upper end of the central staff 22 as the inside diameter is slightly larger than the outside diameter of the staff. The cover 36 is joined to the umbrella with attaching means, both in the center and on the periphery. The center portion of the cover 36 is attached to the ring 38 in any convenient manner, such as a band, clamp, outer friction ring, sewing, tying, compression fitting, shrink tubing, or the like. This attachment provides a waterproof interface and allows the cover 36 to move upwards under the elevated pressure of the wind, creating an expanded chamber above the canopy 32 of the umbrella. The ring 38 has a free upward vertical travel of a minimum of 0.5 inches (1.27 cm) from the at rest position to the fully raised position providing sufficient movement to allow the cover to billow outwardly relieving the air through gaps between the cover 36 and the canopy 32. The upward movement of the cover 36 creates gaps that equalize the pressure differential from the outside to the inside of the umbrella, allowing the device to resist the wind. The cover 36 is attached on the periphery to the ribs 26 and canopy 32 with attaching means consisting of either a plurality of threaded seams 42 or snap fasteners 44, as depicted in FIGS. 1 and 3. The fastening with threads is permanent, as the cover 36 is fixed while the snap fasteners 44 allow removal by disconnecting and slipping the ring 38 off of the end of the staff 24, and yet has sufficient strength to maintain the connection under conditions of high wind.

In order to maintain connection between the cover 36 and the canopy 32, a plurality of resilient axial cover support straps 40 having connecting means, are attached on one end to the ring 38 and on the other to each rib 26 and canopy 32. The middle portion of each strap 40 is connected jointly to a rib 26, a contiguous portion of the canopy 32, and the periphery of the cover 36. These straps 40 are positioned on the outside of the umbrella and act as reinforcement to maintain the shape of the umbrella when stresses are produced by the wind, as the ribs 26 and canopy 32 become reinforced and the cover 36 is held in place in triangular sections and at the periphery. The cover support straps 40 are preferably resilient in nature and may be formed with woven resilient cords and textured fabric. Non-stretching material may be used, however, the flatness of the cover 36 is affected when the umbrella is closed for storage and the full stress load is transmitted instantly to the interface. The end of the straps 40 are attached to the ribs 26 and canopy 32 with connecting means in a similar manner, as the attachments of the cover 36 to the canopy consisting of threaded seams 42, shown in FIG. 1, or snap fasteners 44, illustrated in FIG. 3. The interface of the strap 40 and the cover 36 utilize the same attaching means as previously described.

The inside of the umbrella is reinforced with a plurality of radial canopy support straps 46 having connecting means joined at the intersection of the canopy 32 and ribs 26 in a continuous circle. These radial straps 46, shown in FIG. 4, assist in structurally maintaining the integrity of the shape of the inside of the umbrella and are preferably the same elastic material as the cover straps 40 and are attached in the identical manner.

The invention is used exactly the same as a conventional umbrella since the utility is unaffected, only the ability to withstand the wind has been enhanced. More than one row of struts 28 may be utilized at different angles between the ribs 26 and the staff 24 and other basic embodiments of umbrellas well known in the art may function equally well using the improvement disclosed herein.

While the invention has been described in complete detail and pictorially shown in the accompanying drawings, it is not to be limited to such details, since many changes and modifications may be in the invention without departing from the spirit and the scope thereof. Hence, it is described to cover any and all modifications and forms which may come within the language and scope of the appended claims.

I claim:

1. A wind resistive umbrella comprising:

(a) handle means for gripping and manually carrying the umbrella;

(b) a central staff connected to the handle means on one end and extended to an apex on the other having sufficient structural integrity to maintain its relative shape in a windy environment;

(c) a plurality of ribs distended radially from said staff near the apex in a pivotal manner, said ribs having an extended end opposite that of the staff;

(d) a plurality of struts rotatably connected to said ribs in between the apex of the staff and the rib distended end, further said strut having strut sliding means surrounding said staff with the struts pivotally attached between the rib and the sliding means such that when slid upward toward the apex, the ribs extend outwardly as urged by the struts creating an extended framework;

(e) a canopy covering the framework secured to each of the radially extending ribs of such a size as to be held in tension by the ribs in an open position with the strut sliding means upward relative to the apex, for repelling rain;

(f) said canopy having an air relieving opening in the center thereof radially adjacent to said central staff and spaced evenly therefrom, allowing air to be relieved from the umbrella when wind gusts create a pressure differential on said canopy inside and outside surface;

(g) an air escape cover having canopy attaching means overlaying the air relieving opening in said canopy allowing air to escape from the umbrella through the opening while still maintaining the watershedding ability thereof;

(h) a movable ring slideably encompassing the apex end of said central staff having said cover centrally joined thereupon as part of the attaching means allowing the cover to move upwards under the elevated pressure of the wind creating a plurality of vents between the canopy and the cover equalizing the pressure differential allowing the umbrella to resist the wind;

(i) a plurality of resilient axial cover support straps having connecting means affixed on one end to said movable ring, and on the other to said ribs and canopy also connecting the ribs, canopy, and said cover periphery to the middle of the strap creating a reinforcement between the cover, canopy, and ribs assisting in structurally maintaining the integrity of shape of the umbrella when subjected to differential pressure on the canopy inside and outside caused by the wind; and, (j) a plurality of radial canopy support straps having connecting means joined at the intersection of the canopy and the ribs in a continuous circle assisting in structurally maintaining the integrity of a convex shape of the umbrella in the presence of wind.

2. The umbrella as recited in claim 1 wherein the air relieving opening in said canopy has a diametrical ratio of 0.2:1 to 0.3 to 1 to the overall diameter of the umbrella.

3. The umbrella as recited in claim 1 further comprising said air escape cover having an outside diameter greater than the inside diameter of said air relieving opening providing an overlap therewith to create a waterproof seal.

4. The umbrella as recited in claim 1 further comprising said air escape cover diameter is more than 100 percent greater than the inside diameter of said air relieving opening allowing the cover to lay flat on the canopy under ambient condition without wind.

5. The umbrella as recited in claim 1 wherein said air escape cover canopy attaching means further comprise a plurality of thread seams joining the cover to the canopy and ribs.

6. The umbrella as recited in claim 1 wherein said air escape cover canopy attaching means further comprise a plurality of snap fasteners, one portion affixed to the cover, and a mating portion to said canopy.

7. The umbrella as recited in claim 1 further comprising said movable ring having a free vertical travel of at least 0.50 inches (1.27 cm) from an at rest position to a fully raised position proving sufficient movement to allow the cover to billow outwardly relieving the air through gaps between the cover and the canopy.

8. The invention as recited in claim 1 wherein said axial cover support straps and radial canopy support straps connecting means comprise a plurality of thread seams joining the straps to the canopy and ribs.

9. The invention as recited in claim 1 wherein said axial cover support straps and radial canopy support straps connecting means comprise a plurality of snap fasteners, one portion affixed to the straps, and a mating portion to said canopy.

10. The invention as recited in claim 1 wherein said axial cover support straps and radial canopy straps further comprise an elastic band formed with woven resilient cords and textured fabric.

* * * * *